US009780535B2

(12) United States Patent
Ban et al.

(10) Patent No.: US 9,780,535 B2
(45) Date of Patent: Oct. 3, 2017

(54) SPARK PLUG

(71) Applicant: NGK SPARK PLUG CO., LTD., Nagoya-shi, Aichi (JP)

(72) Inventors: Kenji Ban, Gifu (JP); Kohei Usami, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/298,287

(22) Filed: Oct. 20, 2016

(65) Prior Publication Data

US 2017/0117686 A1 Apr. 27, 2017

(30) Foreign Application Priority Data

Oct. 22, 2015 (JP) ..... 2015-207597

(51) Int. Cl.

| | |
|---|---|
| ***H01T 13/20*** | (2006.01) |
| ***H01T 13/39*** | (2006.01) |
| ***H01T 13/40*** | (2006.01) |
| ***H01T 15/00*** | (2006.01) |

(52) U.S. Cl.

CPC ..... *H01T 13/39* (2013.01); *H01T 13/40* (2013.01); *H01T 15/00* (2013.01)

(58) Field of Classification Search

CPC ..... H01T 13/20; H01T 13/39; H01T 13/40; H01T 15/00

USPC ..... 313/141, 118

See application file for complete search history.

(56) References Cited

U.S. PATENT DOCUMENTS

2014/0361676 A1 12/2014 Ban et al. ..... 313/141

FOREIGN PATENT DOCUMENTS

JP 2014-239015 A 12/2014 ..... H01T 13/20

*Primary Examiner* — Vip Patel
(74) *Attorney, Agent, or Firm* — Kusner & Jaffe

(57) ABSTRACT

A spark plug having a ground electrode, a noble metal tip having a front end that projects forward of a front end portion of the ground electrode, and a center electrode. When S1 represents an area of an overlap region in which a region onto which the center electrode is projected overlaps a region onto which the noble metal tip is projected when the center electrode and the noble metal tip are projected onto an imaginary plane perpendicular to a center line of the center electrode, and S2 represents an area of an overlap region in which a region onto which the noble metal tip is projected overlaps a region onto which the ground electrode is projected when the noble metal tip and the ground electrode are projected onto the imaginary plane, $0.22 \leq S1/S2 \leq 0.68$ is satisfied.

11 Claims, 4 Drawing Sheets

SPARK PLUG

RELATED APPLICATIONS

This application claims the benefit of Japanese Patent Application No. 2015-207597, filed Oct. 22, 2015, the entire contents of which are incorporated herein by reference.

FIELD OF THE INVENTION

The present invention relates to a spark plug.

BACKGROUND OF THE INVENTION

In recent years, trend of high compression and high supercharging in internal combustion engines is advanced in order to improve thermal efficiency (for example, see Japanese Patent Application Laid-Open (kokai) No. 2014-239015). Therefore, spark plugs are required to advantageously exhibit ignitability even when the spark plugs are mounted to such internal combustion engines.

High compression or high supercharging in an internal combustion engine may increase, for example, electric energy to be supplied to a spark plug, as compared to general energy in order to cause stable ignition by the spark plug. However, when the electric energy to be supplied to the spark plug is increased, electrode wear of the spark plug becomes severe while ignitability is improved. Therefore, a spark plug that has an excellent wear resistance while maintaining ignitability even when high electric energy is supplied to the spark plug, is required.

The present invention is made in order to address the aforementioned problem, and can be embodied in the following modes.

SUMMARY OF THE INVENTION (1) According to a first aspect of the present invention, a spark plug is provided. The spark plug includes: a tubular metal shell; an insulator having at least a part of an outer circumference thereof held by the metal shell and having an axial hole; a center electrode provided in the axial hole; a ground electrode having a base end portion fixed to the metal shell, and having one side surface, of a front end portion of the ground electrode, opposing an end surface of the center electrode through a gap; and a noble metal tip provided on the one side surface side of the ground electrode and having a front end that projects forward of the front end portion of the ground electrode. An end surface of the front end portion of the ground electrode and the front end of the noble metal tip are positioned between: an imaginary straight line that is parallel to a center line of the center electrode, and passes through an end point, of the end surface of the center electrode, on a side opposite to a side closer to the base end portion of the ground electrode; and the center line. When S1 represents an area of an overlap region in which a region onto which the end surface of the center electrode is projected overlaps a region onto which the noble metal tip is projected when the noble metal tip and the end surface of the center electrode are projected onto an imaginary plane perpendicular to the center line, and S2 represents an area of an overlap region in which a region onto which the noble metal tip is projected overlaps a region onto which the ground electrode is projected when the noble metal tip and the ground electrode are projected onto the imaginary plane, $0.22 \leq S1/S2 \leq 0.68$ is satisfied.

The spark plug having such a configuration allows wear resistance to be improved while maintaining ignitability even when high electric energy is supplied.

(2) In accordance with a second aspect of the present invention, there is provided a spark plug according to the above aspect, wherein the noble metal tip may project toward the center electrode from the one side surface of the ground electrode, and a projection amount by which the noble metal tip projects from the one side surface toward the center electrode may be less than or equal to 0.35 mm. The spark plug having such a configuration allows improvement of wear resistance of the spark plug to be enhanced.

(3) In accordance with a third aspect of the present invention, there is provided a spark plug according to the above aspect, wherein a coefficient of thermal conductivity of the ground electrode may be higher than a coefficient of thermal conductivity of the noble metal tip. The spark plug having such a configuration allows improvement of wear resistance of the spark plug to be enhanced.

(4) In accordance with a fourth aspect of the present invention, there is provided a spark plug according to the above aspect, wherein the ground electrode may have thereinside a core material having a coefficient of thermal conductivity which is higher than that of the ground electrode. The spark plug having such a configuration allows improvement of wear resistance of the spark plug to be enhanced.

(5) According to a fifth aspect of the present invention, an ignition system is provided. The ignition system includes: a spark plug according to the above aspect; a first power supply configured to apply, between the center electrode and the ground electrode, first power for causing spark discharge in the spark plug, and a second power supply configured to apply second power while the spark discharge is generated. The ignition system having such a configuration allows ignitability of the spark plug to be improved.

The present invention can be implemented not only as the above-described spark plug or ignition system but also in various forms such as a method for manufacturing the spark plug.

DETAILED DESCRIPTION OF THE PREFERRED EMBODIMENTS

A. Embodiment

Figure 1:
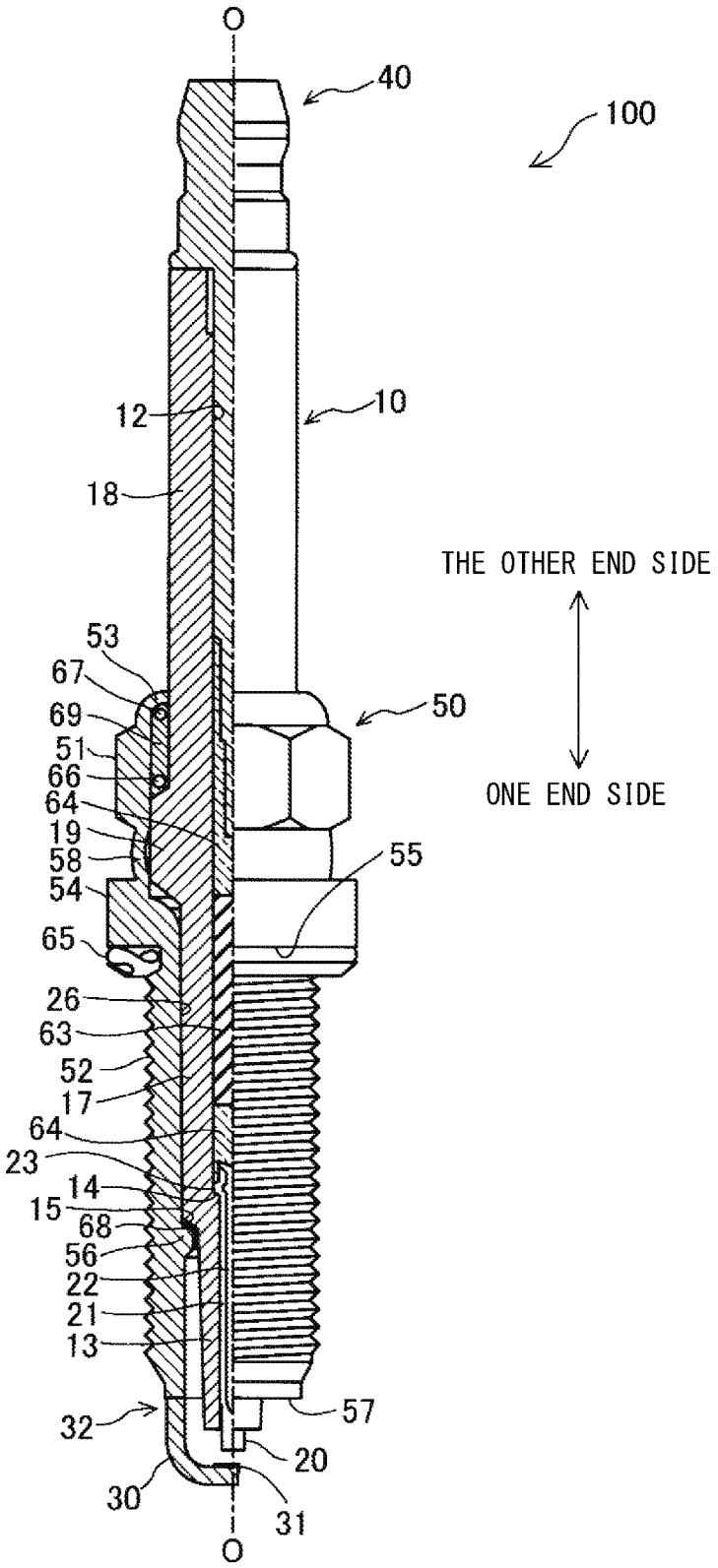
FIG. 1 is a partial cross-sectional view of a spark plug.

FIG. 1 is a partial cross-sectional view of a spark plug 100 according to one embodiment of the present invention. The spark plug 100 has a shape elongated along an axis O. In FIG. 1, a portion to the right of the axis O indicated by alternate long and short dash lines represents the front view of the outer appearance, and a portion to the left of the axis O represents a cross-sectional view of the cross-section that passes through the axis O. In the following description, the lower side in FIG. 1 is referred to as one end side of the spark plug 100 and the upper side in FIG. 1 is referred to as the other end side of the spark plug 100.

The spark plug 100 includes an insulator 10, a center electrode 20, a ground electrode 30, and a tubular metal shell 50. At least a part of the outer circumference of the insulator 10 is held by the metal shell 50, and has an axial hole 12. The center electrode 20 is provided in the axial hole 12. The ground electrode 30 has a base end portion 32 fixed to the metal shell 50. Hereinafter, these components will be described in detail.

The insulator 10 is a ceramic insulator formed by a ceramic material such as alumina being sintered. The insulator 10 is a tubular member which accommodates a part of the center electrode 20 on one end side, accommodates a part of a metal terminal 40 on the other end side, and has the axial hole 12 formed at the center thereof. The insulator 10 has, at the center thereof in the axial direction, a central trunk portion 19 having a large outer diameter. On the other end side of the central trunk portion 19, the other end side trunk portion 18 having an outer diameter less than the central trunk portion 19 is formed. The other end side trunk portion 18 insulates the metal terminal 40 and the metal shell 50 from each other. On one end side of the central trunk portion 19, one end side trunk portion 17 having an outer diameter less than the other end side trunk portion 18 is formed. Further, on one end side of one end side trunk portion 17, a leg portion 13 having an outer diameter that is less than one end side trunk portion 17 and that is reduced toward the center electrode 20, is formed.

The metal shell 50 is a cylindrical metal shell that surrounds and holds a portion, of the insulator 10, extending from a part of the other end side trunk portion 18 to the leg portion 13. The metal shell 50 is formed of, for example, low-carbon steel, and is entirely plated with nickel, zinc, or the like. The metal shell 50 includes a tool engagement portion 51, a seal portion 54, and a mounting screw portion 52 in order, respectively, from the other end side. To the tool engagement portion 51, a tool for mounting the spark plug 100 to an engine head is fitted. The mounting screw portion 52 has thread ridges which are screwed into a mounting screw hole of the engine head. The seal portion 54 is formed so as to be flange-shaped at the root of the mounting screw portion 52. An annular gasket 65 formed by a plate body being bent is inserted between the seal portion 54 and the engine head. An end surface 57, on one end side, of the metal shell 50 is formed into a hollow circular shape, and one end of the leg portion 13 of the insulator 10 and one end of the center electrode 20 project at the center of the end surface 57.

A crimp portion 53 having a reduced thickness is formed in a portion, of the metal shell 50, which is closer to the other end side than the tool engagement portion 51 is. Further, a compressive deformation portion 58 having a reduced thickness as in the crimp portion 53 is formed between the seal portion 54 and the tool engagement portion 51. Annular ring members 66 and 67 are disposed between the inner circumferential surface, of the metal shell 50, which extends from the tool engagement portion 51 to the crimp portion 53, and the outer circumferential surface of the other end side trunk portion 18 of the insulator 10. Further, powder of a talc 69 is filled between both the ring members 66 and 67. When the spark plug 100 is produced, the crimp portion 53 is bent inward and pressed toward one end side, whereby the compressive deformation portion 58 is compressively deformed. By the compressive deformation portion 58 being compressively deformed, the insulator 10 is pressed toward one end side in the metal shell 50 through the ring members 66 and 67 and the talc 69. By the insulator 10 being pressed, the talc 69 is compressed in the direction of the axis O, and airtightness is enhanced in the metal shell 50.

In the inner circumference of the metal shell 50, a ceramic step portion 15 positioned on the other end of the leg portion 13 of the insulator 10 is pressed, through an annular sheet packing 68, against a metal shell step portion 56 formed on the inner circumference of the mounting screw portion 52. The sheet packing 68 is a member for maintaining airtightness between the metal shell 50 and the insulator 10, and prevents outflow of combustion gas.

The center electrode 20 is a bar-like member in which a core material 22 having a thermal conductivity which is more excellent than an electrode base material 21 is embedded in the electrode base material 21. The electrode base material 21 is formed of a nickel alloy containing nickel as a main component. The core material 22 is formed of copper or an alloy containing copper as a main component. To one end side of the center electrode 20, for example, a noble metal tip formed of an iridium alloy or the like, may be joined.

Near the other end portion of the center electrode 20, a flange portion 23 that protrudes on the outer circumference side is formed. The flange portion 23 contacts with an axial hole step portion 14 formed in the axial hole 12, from the other end side, to position the center electrode 20 in the insulator 10. The other end portion of the center electrode 20 is electrically connected to the metal terminal 40 via a seal body 64 and a ceramic resistor 63.

Figure 2:
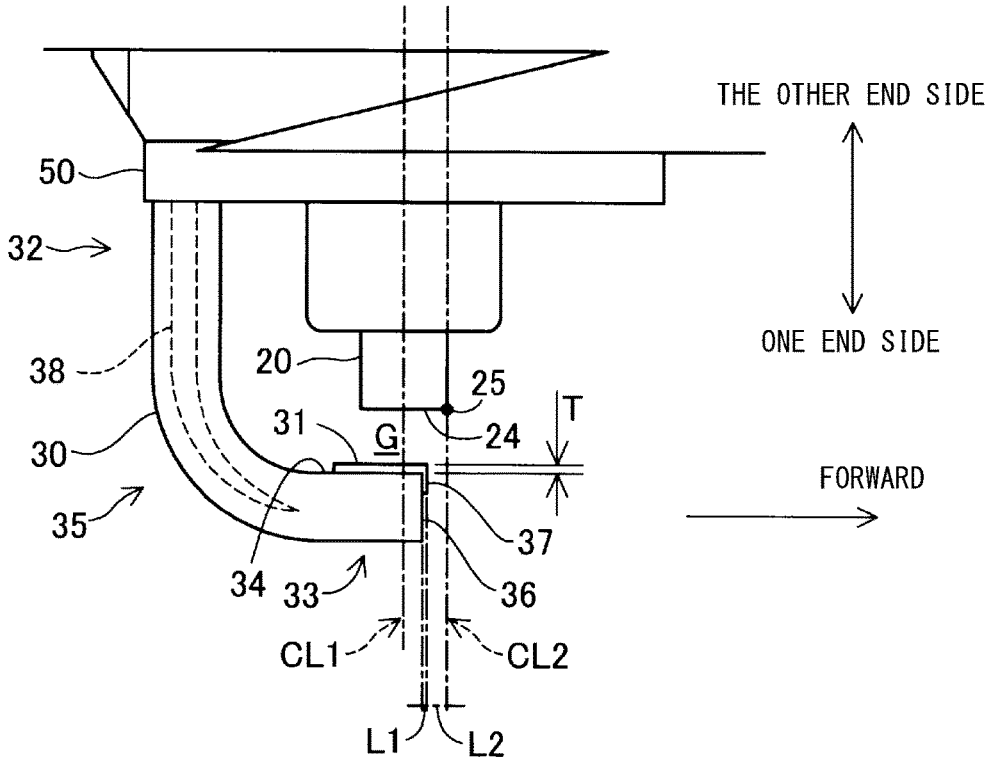
FIG. 2 is an enlarged view of a portion near a ground electrode.

FIG. 2 is an enlarged view of a portion near the ground electrode 30. The ground electrode 30 is formed of an alloy containing nickel as a main component. The ground electrode 30 has the base end portion 32 fixed to the metal shell 50. Further, the ground electrode 30 is formed such that one side surface 34 of a front end portion 33 of the ground electrode 30 opposes an end surface 24, on one end side, of the center electrode 20 through a gap G. When power is supplied to the spark plug 100, spark discharge is caused mainly in the gap G. The gap G is, for example, 0.5 to 1.5 mm in size, and is 1.1 mm in size in the present embodiment. An intermediate portion 35 between the base end portion 32 and the front end portion 33 of the ground electrode 30 is bent.

On one side surface 34 side of the ground electrode 30, a noble metal tip 31 having a front end 37 that projects forward of the front end portion 33 of the ground electrode 30, is formed. "Forward of the front end portion 33 of the ground electrode 30" means "forward of the front end portion 33 of the ground electrode 30 in a direction in which an end surface 36 of the front end portion 33 of the ground electrode 30 faces (the right side on the surface of sheet in FIG. 2). In the present embodiment, the front end 37 of the noble metal tip 31 projects forward of the front end portion 33 of the ground electrode 30. Therefore, spark can be inhibited from being discharged to the end surface 36 of the ground electrode 30, whereby the ground electrode 30 can be inhibited from being worn.

The noble metal tip 31 is formed of a platinum alloy. The noble metal tip 31 is fitted into a recess that is previously formed on one side surface 34 side of the front end portion 33 of the ground electrode 30, and laser beam welding is performed in a boundary portion between the noble metal tip 31 and the ground electrode 30, whereby the noble metal tip 31 is fixed to the ground electrode 30. The noble metal tip 31 may not be fitted into the recess, but may be joined directly to one side surface 34, of the ground electrode 30, which is plane. Further, the noble metal tip 31 and the ground electrode 30 may be jointed to each other by resistance welding.

In the present embodiment, the end surface 36 of the front end portion 33 of the ground electrode 30, and the front end 37 of the noble metal tip 31 are positioned between an imaginary line CL2, and a center line CL1 that is the axis of the center electrode 20. The imaginary line CL2 is an imaginary straight line that is parallel to the center line CL1, and that passes through an end point 25, of the end surface 24 of the center electrode 20, on a side opposite to the side closer to the base end portion 32 of the ground electrode 30. In the present embodiment, the end surface 36 of the front end portion 33 of the ground electrode 30, and the front end 37 of the noble metal tip 31, are thus positioned between the center line CL1 and the imaginary straight line CL2, whereby prevention of growing of flame into a cylinder can be inhibited more effectively as compared to a case where the ground electrode 30 and the noble metal tip 31 are positioned at positions beyond the imaginary straight line CL2. Further, spark can be inhibited from being discharged to the end surface 36 of the ground electrode 30 more effectively as compared to a case where the ground electrode 30 and the noble metal tip 31 are positioned at positions that do not reach the center line CL1, whereby the ground electrode 30 can be inhibited from being worn. In the present embodiment, the position of the imaginary straight line CL2 and the position of the center line CL1 are "between the imaginary straight line CL2 and the center line CL1". Further, in the present embodiment, the axis O and the center line CL1 of the center electrode 20 are the same.

Figure 3:
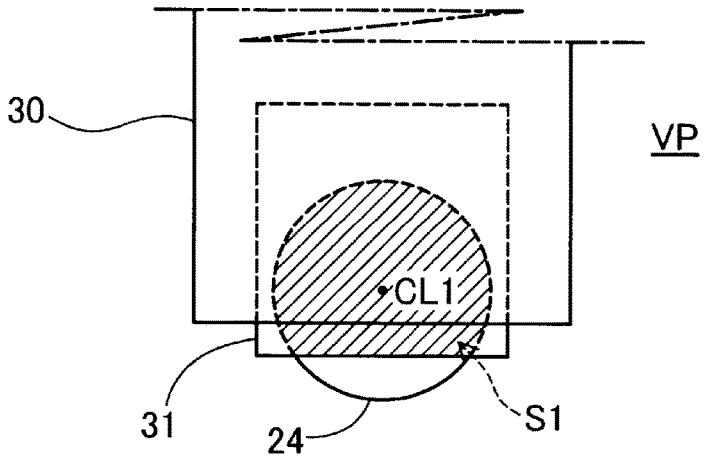
FIG. 3 is a view showing a state in which a center electrode, the ground electrode, and a noble metal tip are projected onto an imaginary plane.
Figure 4:
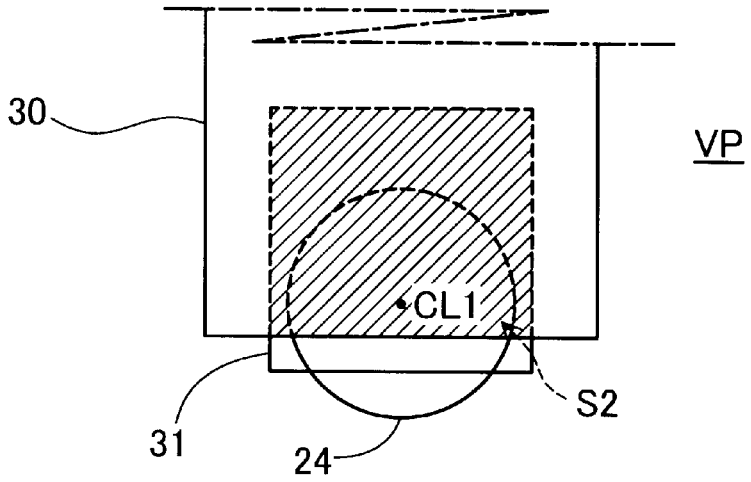
FIG. 4 is a view showing a state in which the center electrode, the ground electrode, and the noble metal tip are projected onto the imaginary plane.

FIG. 3 and FIG. 4 each show a state in which the center electrode 20, the ground electrode 30, and the noble metal tip 31 are projected onto an imaginary plane VP perpendicular to the center line CL1. In the present embodiment, the shape of the noble metal tip 31 on the imaginary plane VP is a square. The shape thereof is not limited to a square, and may be, for example, a rectangular shape, an ellipsoidal shape, a circular shape, or a polygonal shape.

In FIG. 3, the hatching represents an overlap region in which a region onto which the end surface 24 of the center electrode 20 is projected overlaps a region onto which the noble metal tip 31 is projected when the end surface 24 of the center electrode 20, and the noble metal tip 31 are projected onto the imaginary plane VP. The area of the overlap region is represented as an "area S1". In FIG. 4, the hatching represents an overlap region in which a region onto which the noble metal tip 31 is projected overlaps a region onto which the ground electrode 30 is projected when the noble metal tip 31 and the ground electrode 30 are projected onto the imaginary plane VP. The area of the overlap region is represented as an "area S2". The area S1 and the area S2 preferably satisfy the following expression (1).

$$0.22 \leq S1/S2 \leq 0.68 \quad (1)$$

In the above expression (1), "S1/S2" represents a ratio, in area, of a portion (area S1) at which heat is received by the noble metal tip 31 in spark discharge in the gap G, relative to a portion (area S2) at which the received heat is emitted to the ground electrode 30 by the noble metal tip 31. When the ratio S1/S2 in area is great, heat received at the portion having the area S1 cannot be appropriately emitted at the portion having the area S2, thereby reducing wear resistance. However, when the ratio S1/S2 in area is great, heat is not easily emitted, thereby improving ignitability. When the ratio S1/S2 in area is small, heat received at the portion having the area S1 can be appropriately emitted at the portion having the area S2, thereby improving wear resistance. However, when the ratio S1/S2 in area is small, heat is easily emitted, thereby reducing ignitability. In the present embodiment, the value of the ratio S1/S2 in area is greater than or equal to 0.22, and not greater than 0.68 as described above. Thus, wear resistance of the ground electrode 30 can be improved while ignitability of the spark plug 100 is maintained. In particular, when the spark plug 100 is mounted to an internal combustion engine in a highly compressed and highly supercharged state, high electric energy (for example, higher than or equal to 100 mJ) may be applied to the spark plug 100 in order to improve ignitability. Also in such a case, the spark plug 100 of the present embodiment allows wear resistance to be improved while maintaining ignitability. The range of the values in expression (1) is determined on the basis of the result of a test described below.

In the spark plug 100 of the present embodiment, as shown in FIG. 2, the noble metal tip 31 projects toward the center electrode 20 from one side surface 34 of the front end portion 33 of the ground electrode 30. The projection amount T is preferably less than or equal to 0.40 mm, and more preferably less than or equal to 0.35 mm. When the projection amount T is the above-described amount, the projection amount T of the noble metal tip 31 is relatively small, whereby a distance over which heat received by the noble metal tip 31 is transmitted to the ground electrode 30 is shortened. Therefore, heat received by the noble metal tip 31 can be rapidly emitted to the ground electrode 30, whereby improvement of wear resistance of the ground electrode 30 can be enhanced. The values of 0.40 mm and 0.35 mm are determined on the basis of the result of a test described below.

In the spark plug 100 of the present embodiment, the coefficient of thermal conductivity of the ground electrode 30 is preferably higher than the coefficient of thermal conductivity of the noble metal tip 31. When the coefficient of thermal conductivity of the ground electrode 30 is higher than that of the noble metal tip 31, heat received by the noble metal tip 31 can be rapidly emitted to the ground electrode 30, whereby improvement of wear resistance of the ground electrode 30 can be enhanced. The coefficient of thermal conductivity can be measured by, for example, a laser flash method.

In the present embodiment, the ground electrode 30 preferably has thereinside a core material 38 having a coefficient of thermal conductivity which is higher than that of the ground electrode 30 as indicated by a dashed line in FIG. 2. When such a core material 38 is enclosed in the ground electrode 30, heat received by the noble metal tip 31 can be more rapidly emitted, whereby improvement of wear resistance of the ground electrode 30 can be enhanced. One end of the core material 38 preferably extends to a portion near the noble metal tip 31, and the other end of the core material 38 preferably extends to the metal shell 50. The coefficient of thermal conductivity of the core material 38 is preferably higher than the coefficients of thermal conductivity of both the ground electrode 30 and the noble metal tip 31. Further, the coefficient of thermal conductivity is preferably increased in the order of the noble metal tip 31, the ground electrode 30, and the core material 38. The core material 38 may be formed of, for example, a copper alloy or pure nickel. The ground electrode 30 having the core material 38 can be produced by, for example, a clad material that has a material forming the core material 38 at the center of the material forming the ground electrode 30, being subjected to plastic processing such as drawing process.

Figure 5:
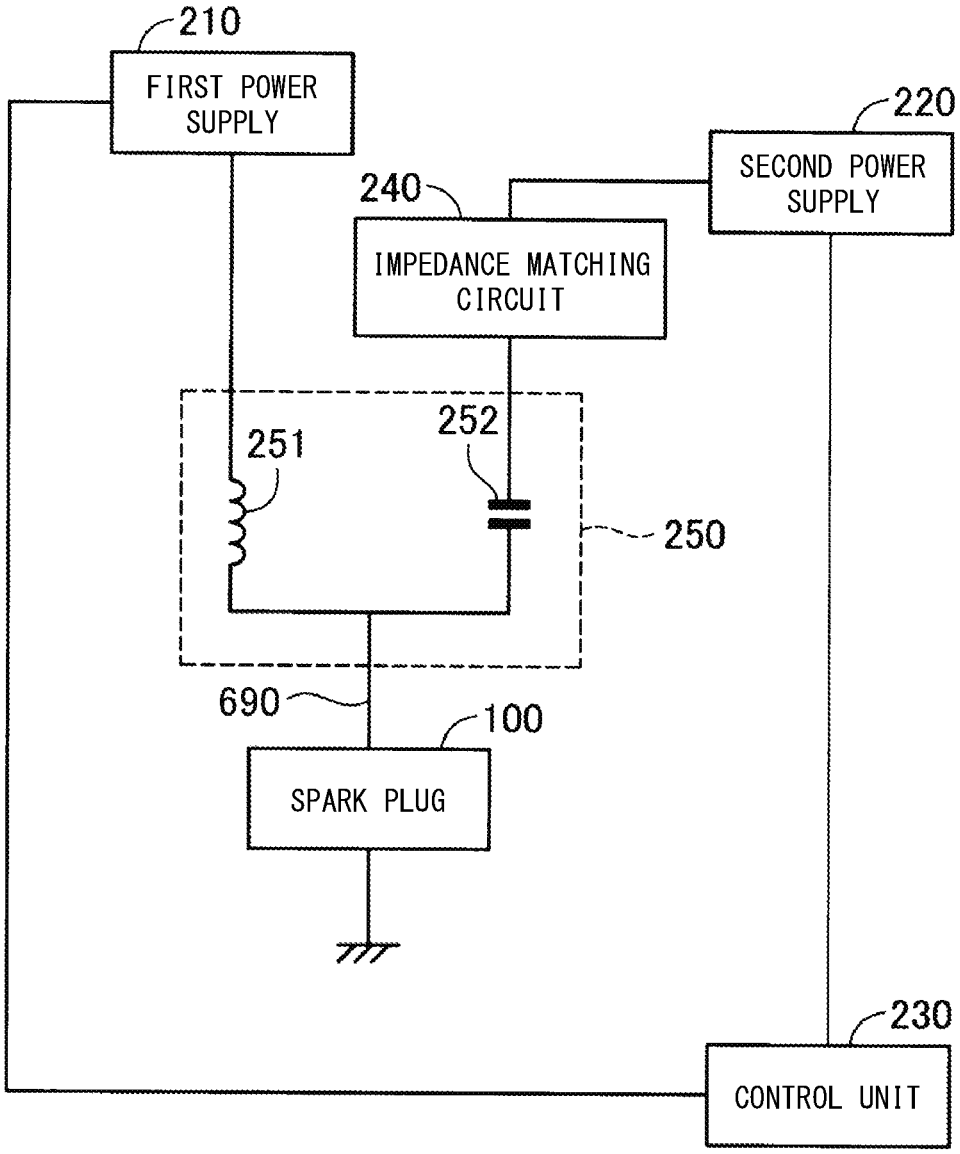
FIG. 5 is a view of a schematic configuration of an ignition system.

FIG. 5 illustrates a schematic configuration of an ignition system 200 that includes the spark plug 100. The ignition system 200 is a system for igniting air-fuel mixture supplied to the internal combustion engine. The ignition system 200 includes the spark plug 100, a first power supply 210, and a second power supply 220. The ignition system 200 further includes a control unit 230, an impedance matching circuit 240, and a mixing circuit 250.

The first power supply 210 is a power supply that applies, as first power, a high voltage for causing spark discharge in the spark plug 100, between the center electrode 20 and the ground electrode 30.

The second power supply 220 is a power supply that applies, as second power, a voltage having a relatively high frequency (for example, higher than or equal to 1 MHz and not higher than 20 MHz), to the spark plug 100. The second power is applied between the center electrode 20 and the ground electrode 30 by the second power supply 220 while spark discharge is generated.

The mixing circuit 250 connects the first power supply 210 and the second power supply 220 to the spark plug 100. The mixing circuit 250 includes a coil 251 and a capacitor 252. The coil 251 is connected between the first power supply 210 and the spark plug 100. The capacitor 252 is connected between the second power supply 220 and the spark plug 100. The coil 251 inhibits power from the second power supply 220 from being inputted into the first power supply 210. The capacitor 252 inhibits power from the first power supply 210 from being inputted into the second power supply 220. When the first power supply 210 includes a coil, the coil 251 may not be provided.

The impedance matching circuit 240 is connected between the second power supply 220 and the mixing circuit 250. The impedance matching circuit 240 matches an output impedance of the second power supply 220 with an input impedance on the mixing circuit 250 and the spark plug 100 sides (that is, load side) during spark discharge in the gap G. Thus, attenuation of the second power supplied to the spark plug 100 can be inhibited.

The control unit 230 is a device for controlling a time when power is supplied to the spark plug 100 from each of the first power supply 210 and the second power supply 220. The control unit 230 is formed by, for example, an ECU (Electronic Control Unit) that includes a CPU (Central Processing Unit) and a memory.

The ignition system 200 having such a structure allows high electric energy to be supplied to the spark plug 100. For example, electric energy of 400 to 500 mJ which is a sum of the first power and the second power can be supplied to the spark plug 100. Therefore, even when the spark plug 100 is mounted to an internal combustion engine in a highly compressed and highly supercharged state, ignitability for air-fuel mixture can be improved.

B. Result of Evaluation Test

B1. Ratio S1/S2 in Area:

Table 1 indicates test results of an ignitability test and a wear resistance test for various samples (sample Nos. 1 to 30) of the spark plug 100. The test result represents a relative evaluation in comparison with a spark plug (sample No. 0) that was prepared as comparative example. The ground electrodes 30 of the samples including the sample of comparative example were formed of the same material (Inconel (registered trademark) 601). Further, the noble metal tips 31 of the samples including the sample of comparative example were formed of the same material (platinum alloy). In each of the samples indicated in Table 1, the coefficient of thermal conductivity of the ground electrode 30 is lower than the coefficient of thermal conductivity of the noble metal tip 31. In each of the samples including the sample of comparative example, the gap G was 1.1 mm in size. In each of the samples including the sample of comparative example, the ground electrode 30 did not include the core material 38.

TABLE 1

| No. | Center electrode (mm) | Tip size (mm) | Ground electrode (mm) | L1 (mm) | L2 (mm) | T (mm) | S1 ($mm^2$) | S2 ($mm^2$) | S1/S2 | Ignitability | Wear resistance |
|---|---|---|---|---|---|---|---|---|---|---|---|
| 0 | Φ1.2 | 1.5 × 0.7 | 2.7 | 0.65 | 0.00 | 0.30 | 0.79 | 0.60 | 1.32 | — | — |
| 1 | Φ0.8 | 0.9 × 0.9 | 2.7 | 0.10 | 0.20 | 0.40 | 0.40 | 0.72 | 0.56 | A | A |
| 2 | Φ0.8 | 0.9 × 0.9 | 2.7 | 0.20 | 0.10 | 0.40 | 0.47 | 0.63 | 0.74 | A | B |
| 3 | Φ0.8 | 1.4 × 1.4 | 2.7 | 0.10 | 0.20 | 0.40 | 0.40 | 1.82 | 0.22 | A | A |
| 4 | Φ0.8 | 1.4 × 1.4 | 2.7 | 0.20 | 0.10 | 0.40 | 0.47 | 1.68 | 0.28 | A | A |
| 5 | Φ0.8 | 1.8 × 1.8 | 2.7 | 0.10 | 0.20 | 0.40 | 0.40 | 3.06 | 0.13 | B | A |
| 6 | Φ0.8 | 1.8 × 1.8 | 2.7 | 0.20 | 0.10 | 0.40 | 0.47 | 2.88 | 0.16 | B | A |
| 7 | Φ1.1 | 1.4 × 1.4 | 2.7 | 0.10 | 0.20 | 0.40 | 0.83 | 1.82 | 0.46 | A | A |
| 8 | Φ1.1 | 1.4 × 1.4 | 2.7 | 0.10 | 0.40 | 0.40 | 0.64 | 1.82 | 0.35 | A | A |
| 9 | Φ1.1 | 1.4 × 1.4 | 2.7 | 0.30 | 0.10 | 0.40 | 0.91 | 1.54 | 0.59 | A | A |
| 10 | Φ1.1 | 1.9 × 1.9 | 2.7 | 0.10 | 0.20 | 0.40 | 0.83 | 3.42 | 0.24 | A | A |
| 11 | Φ1.1 | 1.9 × 1.9 | 2.7 | 0.30 | 0.20 | 0.40 | 0.83 | 3.04 | 0.27 | A | A |
| 12 | Φ1.1 | 2.2 × 2.2 | 2.7 | 0.10 | 0.20 | 0.40 | 0.83 | 4.62 | 0.18 | B | A |
| 13 | Φ1.1 | 2.2 × 2.2 | 2.7 | 0.30 | 0.10 | 0.40 | 0.91 | 4.18 | 0.22 | A | A |
| 14 | Φ1.1 | 2.2 × 2.2 | 2.7 | 0.30 | 0.20 | 0.40 | 0.83 | 4.18 | 0.20 | B | A |
| 15 | Φ1.6 | 1.9 × 1.9 | 2.7 | 0.10 | 0.20 | 0.40 | 1.87 | 3.42 | 0.55 | A | A |
| 16 | Φ1.6 | 1.9 × 1.9 | 2.7 | 0.10 | 0.40 | 0.40 | 1.62 | 3.42 | 0.47 | A | A |
| 17 | Φ1.6 | 1.9 × 1.9 | 2.7 | 0.10 | 0.60 | 0.40 | 1.32 | 3.42 | 0.39 | A | A |
| 18 | Φ1.6 | 1.9 × 1.9 | 2.7 | 0.30 | 0.10 | 0.40 | 1.96 | 3.04 | 0.64 | A | A |
| 19 | Φ1.6 | 1.9 × 1.9 | 2.7 | 0.30 | 0.40 | 0.40 | 1.62 | 3.04 | 0.53 | A | A |
| 20 | Φ1.6 | 1.9 × 1.9 | 2.7 | 0.50 | 0.10 | 0.40 | 1.96 | 2.66 | 0.74 | A | B |
| 21 | Φ1.6 | 1.9 × 1.9 | 2.7 | 0.50 | 0.25 | 0.40 | 1.81 | 2.66 | 0.68 | A | A |
| 22 | Φ1.6 | 2.2 × 2.2 | 2.7 | 0.10 | 0.20 | 0.40 | 1.87 | 4.62 | 0.40 | A | A |
| 23 | Φ1.6 | 2.2 × 2.2 | 2.7 | 0.10 | 0.40 | 0.40 | 1.62 | 4.62 | 0.35 | A | A |
| 24 | Φ1.6 | 2.2 × 2.2 | 2.7 | 0.50 | 0.25 | 0.40 | 1.81 | 3.74 | 0.48 | A | A |
| 25 | Φ2.0 | 2.2 × 2.2 | 2.7 | 0.10 | 0.40 | 0.40 | 2.69 | 4.62 | 0.58 | A | A |
| 26 | Φ2.0 | 2.2 × 2.2 | 2.7 | 0.10 | 0.80 | 0.40 | 1.97 | 4.62 | 0.43 | A | A |
| 27 | Φ2.0 | 2.2 × 2.2 | 2.7 | 0.30 | 0.10 | 0.40 | 3.08 | 4.18 | 0.74 | A | B |
| 28 | Φ2.0 | 2.2 × 2.2 | 2.7 | 0.30 | 0.50 | 0.40 | 2.53 | 4.18 | 0.60 | A | A |

TABLE 1-continued

| No. | Center electrode (mm) | Tip size (mm) | Ground electrode (mm) | L1 (mm) | L2 (mm) | T (mm) | S1 ($mm^2$) | S2 ($mm^2$) | S1/S2 | Ignita-bility | Wear resistance |
|---|---|---|---|---|---|---|---|---|---|---|---|
| 29 | Φ2.0 | 2.2 × 2.2 | 2.7 | 0.50 | 0.10 | 0.40 | 3.08 | 3.74 | 0.82 | A | B |
| 30 | Φ2.0 | 2.2 × 2.2 | 2.7 | 0.50 | 0.40 | 0.40 | 2.70 | 3.74 | 0.72 | A | B |

In Table 1, the dimension of the "center electrode" represents a diameter of the end surface 24 of the center electrode 20. The "tip size" represents the dimension of the noble metal tip 31 on the plane perpendicular to the axis O. In each of the samples of No. 1 to No. 30, the shape of the noble metal tip 31 was a square on the plane perpendicular to the axis O. Meanwhile, the shape of a noble metal tip of comparative example (sample No. 0) was a rectangular shape on the plane perpendicular to the axis O. The longitudinal direction of the noble metal tip of comparative example was along the left-right direction on the surface of the sheet in FIG. 2. In Table 1, the dimension of the "ground electrode" represents a dimension, in the width direction, of the ground electrode.

In Table 1, "L1" represents a distance, along the direction perpendicular to the axis O, from the end surface 36 of the front end portion 33 of the ground electrode 30, to the front end 37 of the noble metal tip 31, as shown in FIG. 2. Further, "L2" represents a distance, along the direction perpendicular to the axis O, from the front end 37 of the noble metal tip 31 to the imaginary straight line CL2. As indicated by the value of L1, in each sample, the noble metal tip 31 projected forward of the front end portion 33 of the ground electrode 30. Further, as indicated by the values of L1 and L2, and the dimension of the center electrode, in each sample except for the sample of comparative example, the end surface 36 of the front end portion 33 of the ground electrode 30 and the front end 37 of the noble metal tip 31 were positioned between the imaginary straight line CL2 and the center line CL1.

In Table 1, "ignitability" represents the result of the ignitability test for each sample. In the ignitability test, each sample was mounted to an in-line 4-cylinder DOHC engine having a displacement of 1.5 L and using natural air intake. The engine revolution was set as 1200 rpm, and the ignition energy was set as 200 mJ, and an air/fuel ratio (A/F) was maintained as 14.5, and an ignition timing was set as a timing (MBT) at which the torque became maximum, and exhaust gas recirculation (EGR) was performed. An EGR rate at which a torque fluctuation due to the exhaust gas recirculation became 5% was defined as an EGR limit, and the EGR limit was compared with that of comparative example. Samples each having the EGR limit that was equivalent to or better than that of comparative example are represented as "A" in Table 1. Meanwhile, samples each having the EGR limit that was worse than that of comparative example are represented as "B" in Table 1.

In Table 1, "wear resistance" represents the result of the wear resistance test for each sample. In the wear resistance test, each ample was mounted to an in-line 3-cylinder DOHC engine having a displacement of 0.66 L and having a supercharger. The engine revolution was set as 3600 rpm, and the ignition energy was set as 200 mJ. After running for 200 hours, the wear volume (reduced volume) of the noble metal tip 31 was compared with that of comparative example. Samples in each of which the wear volume was equivalent to or greater than that of comparative example are represented as "B" in Table 1. Meanwhile, samples in each of which the wear volume was less than that of comparative example by 5% or less are represented as "A". In other tables described below, samples in each of which the wear volume was less than that of comparative example in a range from more than 5% to 7% or less, are represented as S, samples in each of which the wear volume was less than that of comparative example in a range from more than 7% to 11% or less, are represented as SS, and samples in each of which the wear volume was less than that of comparative example in a range from more than 11% to 15% or less, are represented as SSS, which are not indicated in Table 1. The wear volume of the noble metal tip 31 was calculated by a three-dimensional CT image of the noble metal tip 31 being taken and analyzed.

Referring to Table 1, in a case where the diameter of the center electrode 20, the tip size, and the distances L1, L2 were variously changed, when the ratio S1/S2 in area was less than 0.22, ignitability was worse than that of comparative example. Meanwhile, when the ratio S1/S2 in area was greater than or equal to 0.22, the ignitability was equivalent to or better than that of comparative example. Further, when the ratio S1/S2 in area was greater than 0.68, wear resistance was equivalent to or worse than that of comparative example. Meanwhile, when the ratio S1/S2 in area was not greater than 0.68, wear resistance was improved as compared to comparative example. That is, the test result indicates that, when the ratio S1/S2 in area is greater than or equal to 0.22 and not greater than 0.68, wear resistance can be improved while ignitability is maintained. Therefore, the result of the evaluation test in Table 1 indicates that the ratio S1/S2 in area is preferably greater than or equal to 0.22 and preferably not greater than 0.68 in the spark plug 100 of the above embodiment.

B2. Projection Amount T:

Table 2 indicates the evaluation result of ignitability and the evaluation result of wear resistance in the case of the projection amount T being changed from 0.10 mm to 0.40 mm in samples that were under the same conditions as the samples of No. 16 and No. 19 indicated in Table 1.

TABLE 2

| No. | Center electrode (mm) | Tip size (mm) | Ground electrode (mm) | L1 (mm) | L2 (mm) | T (mm) | S1 ($mm^2$) | S2 ($mm^2$) | S1/S2 | Ignita-bility | Wear resistance |
|---|---|---|---|---|---|---|---|---|---|---|---|
| 16 | Φ1.6 | 1.9 × 1.9 | 2.7 | 0.10 | 0.40 | 0.10 | 1.62 | 3.42 | 0.47 | A | S |
| 16-1 | Φ1.6 | 1.9 × 1.9 | 2.7 | 0.10 | 0.40 | 0.20 | 1.62 | 3.42 | 0.47 | A | S |
| 16-2 | Φ1.6 | 1.9 × 1.9 | 2.7 | 0.10 | 0.40 | 0.30 | 1.62 | 3.42 | 0.47 | A | S |

TABLE 2-continued

| No. | Center electrode (mm) | Tip size (mm) | Ground electrode (mm) | L1 (mm) | L2 (mm) | T (mm) | S1 ($mm^2$) | S2 ($mm^2$) | S1/S2 | Ignita-bility | Wear resistance |
|---|---|---|---|---|---|---|---|---|---|---|---|
| 16-3 | Φ1.6 | 1.9 × 1.9 | 2.7 | 0.10 | 0.40 | 0.35 | 1.62 | 3.42 | 0.47 | A | S |
| 16-4 | Φ1.6 | 1.9 × 1.9 | 2.7 | 0.10 | 0.40 | 0.40 | 1.62 | 3.42 | 0.47 | A | A |
| 19 | Φ1.6 | 1.9 × 1.9 | 2.7 | 0.30 | 0.40 | 0.10 | 1.62 | 3.04 | 0.53 | A | S |
| 19-1 | Φ1.6 | 1.9 × 1.9 | 2.7 | 0.30 | 0.40 | 0.20 | 1.62 | 3.04 | 0.53 | A | S |
| 19-2 | Φ1.6 | 1.9 × 1.9 | 2.7 | 0.30 | 0.40 | 0.30 | 1.62 | 3.04 | 0.53 | A | S |
| 19-3 | Φ1.6 | 1.9 × 1.9 | 2.7 | 0.30 | 0.40 | 0.35 | 1.62 | 3.04 | 0.53 | A | S |
| 19-4 | Φ1.6 | 1.9 × 1.9 | 2.7 | 0.30 | 0.40 | 0.40 | 1.62 | 3.04 | 0.53 | A | A |

The evaluation result in Table 2 indicates that ignitability was advantageous regardless of the projection amount T, and that, for wear resistance, the projection amount T was preferably less than or equal to 0.40 mm, and more preferably less than or equal to 0.35 mm. Therefore, the result of the evaluation test in Table 2 indicates that the projection amount T is preferably less than or equal to 0.40 mm, and more preferably less than or equal to 0.35 mm in the spark plug 100 of the above embodiment.

B3. Coefficient of Thermal Conductivity:

Table 3 indicates the evaluation result of ignitability and the evaluation result of wear resistance in the case of the coefficient of thermal conductivity of the ground electrode 30 being changed in the samples of No. 16-1 and No. 16-4 indicated in Table 2.

TABLE 3

| No. | Center electrode (mm) | Tip size (mm) | Ground electrode (mm) | L1 (mm) | L2 (mm) | T (mm) | S1 ($mm^2$) | S2 ($mm^2$) | S1/S2 | Ignita-bility | Wear resistance |
|---|---|---|---|---|---|---|---|---|---|---|---|
| 16-1 | Φ1.6 | 1.9 × 1.9 | 2.7 | 0.1 | 0.4 | 0.2 | 1.62 | 3.42 | 0.47 | A | S |
| 16-1-1 | Φ1.6 | 1.9 × 1.9 | 2.7 | 0.1 | 0.4 | 0.2 | 1.62 | 3.42 | 0.47 | A | SS |
| 16-4 | Φ1.6 | 1.9 × 1.9 | 2.7 | 0.1 | 0.4 | 0.4 | 1.62 | 3.42 | 0.47 | A | A |
| 16-4-1 | Φ1.6 | 1.9 × 1.9 | 2.7 | 0.1 | 0.4 | 0.4 | 1.62 | 3.42 | 0.47 | A | S |

In the samples of No. 16-1 and No. 16-4, the ground electrode 30 was formed of Inconel (registered trademark) 601, and the coefficient of thermal conductivity of the ground electrode 30 was 31.33 [W/(m·K)] at 1000° C. The noble metal tip 31 was formed of a platinum alloy, and the coefficient of thermal conductivity of the noble metal tip 31 was 59.6 [W/(m·K)] at 1000° C. That is, in the samples of No. 16-1 and No. 16-4, the coefficient of thermal conductivity of the ground electrode 30 was lower than the coefficient of thermal conductivity of the noble metal tip 31.

Meanwhile, in the samples of No. 16-1-1 and No. 16-4-1, the ground electrode 30 was formed of a high nickel alloy, and the coefficient of thermal conductivity of the ground electrode 30 was 120.4 [W/(m·K)] at 1000° C. The noble metal tip 31 was formed of a platinum alloy, and the coefficient of thermal conductivity of the noble metal tip 31 was 59.6 [W/(m·K)] at 1000° C. That is, in the samples of No. 16-1-1 and No. 16-4-1, the coefficient of thermal conductivity of the ground electrode 30 was higher than the coefficient of thermal conductivity of the noble metal tip 31.

Referring to Table 3, in samples of No. 16-1-1 and No. 16-4-1 in which the coefficient of thermal conductivity of the ground electrode 30 was higher than the coefficient of thermal conductivity of the noble metal tip 31, wear resistance was better than in the samples of No. 16-1 and No. 16-4 in which the coefficient of thermal conductivity of the ground electrode 30 was lower than the coefficient of thermal conductivity of the noble metal tip 31. Therefore, the result of the evaluation test in Table 3 indicates that the coefficient of thermal conductivity of the ground electrode 30 is preferably higher than the coefficient of thermal conductivity of the noble metal tip 31 in the spark plug 100 of the above embodiment.

B4. Presence or Absence of Core Material:

Table 4 indicates that the evaluation result of ignitability and the evaluation result of wear resistance in the case of the core material 38 being provided in the ground electrode 30.

TABLE 4

| No. | Center electrode (mm) | Tip size (mm) | Ground electrode (mm) | L1 (mm) | L2 (mm) | T (mm) | S1 ($mm^2$) | S2 ($mm^2$) | S1/S2 | Ignita-bility | Wear resistance |
|---|---|---|---|---|---|---|---|---|---|---|---|
| 16-1-1 | Φ1.6 | 1.9 × 1.9 | 2.7 | 0.10 | 0.40 | 0.20 | 1.62 | 3.42 | 0.47 | A | SS |
| 16-1-2 | Φ1.6 | 1.9 × 1.9 | 2.7 | 0.10 | 0.40 | 0.20 | 1.62 | 3.42 | 0.47 | A | SSS |
| 16-4-1 | Φ1.6 | 1.9 × 1.9 | 2.7 | 0.10 | 0.40 | 0.40 | 1.62 | 3.42 | 0.47 | A | S |
| 16-4-2 | Φ1.6 | 1.9 × 1.9 | 2.7 | 0.10 | 0.40 | 0.40 | 1.62 | 3.42 | 0.47 | A | SS |

The samples of No. 16-1-1 and No. 16-4-1 indicated in Table 4 are the same as the samples indicated in Table 3, and the core material 38 was not included in the ground electrode 30 in each sample. Meanwhile, in each of samples of No. 16-1-2 and No. 16-4-2, a copper alloy having the coefficient of thermal conductivity of 390.0 [W/m·K] at 1000° C. was enclosed as the core material 38 in the ground electrode 30.

Referring to Table 4, in the samples of No. 16-1-2 and No. 16-4-2 in which the core material 38 was enclosed in the ground electrode 30, wear resistance was better than in the samples of No. 16-1-1 and No. 16-4-1 in which the core material 38 was not enclosed in the ground electrode 30. Therefore, the result of the evaluation test in Table 4 indicates that the ground electrode 30 preferably has thereinside the core material 38 having a coefficient of thermal conductivity which is higher than that of the ground electrode 30 in the spark plug 100 of the above embodiment.

C. Modifications

Modification 1

In the above embodiment, the noble metal tip 31 projects toward the center electrode 20 from one side surface 34 of the ground electrode 30. However, the noble metal tip 31 may not project from one side surface 34 of the ground electrode 30. Further, the projection amount T may be greater than 0.35 mm.

Modification 2

In the above embodiment, the coefficient of thermal conductivity of the ground electrode 30 may be lower than the coefficient of thermal conductivity of the noble metal tip 31.

Modification 3

In the above embodiment, the ground electrode 30 may not have the core material 38.

Modification 4

The configuration of the ignition system 200 is not limited to the configuration shown in FIG. 5, and various configurations can be used for the ignition system 200. For example, the ignition system 200 may not include the second power supply 220, the impedance matching circuit 240, and/or the mixing circuit 250, and power may be supplied by the first power supply 210.

Modification 5

The spark plug 100 according to the above embodiment may not include the ceramic resistor 63.

The present invention is not limited to the embodiments, examples, and modifications described above, and can be embodied in various configurations without departing from the gist of the present invention. For example, the technical features in the embodiments, examples, and modifications corresponding to the technical features in each aspect described in the Summary of the Invention section can be appropriately replaced or combined to solve some of or all of the foregoing problems, or to achieve some of or all of the foregoing effects. Further, such technical features can be appropriately deleted if not described as being essential in the present specification.

DESCRIPTION OF REFERENCE NUMERALS

10: insulator;
12: axial hole;
13: leg portion;
14: axial hole step portion;
15: ceramic step portion;
17: one end side trunk portion;
18: the other end side trunk portion;
19: central trunk portion;
20: center electrode;
21: electrode base material;
22: core material;
23: flange portion;
24: end surface;
25: end point;
30: ground electrode;
31: noble metal tip;
32: base end portion;
33: front end portion;
34: one side surface;
35: intermediate portion;
36: end surface;
37: front end;
38: core material;
40: metal terminal;
50: metal shell;
51: tool engagement portion;
52: mounting screw portion;
53: crimp portion;
54: seal portion;
56: metal shell step portion;
57: end surface;
58: compressive deformation portion;
63: ceramic resistor;
64: seal body;
65: gasket;
66, 67: ring member;
68: sheet packing;
69: talc;
100: spark plug;
200: ignition system;
210: first power supply;
220: second power supply;
230: control unit;
240: impedance matching circuit;
250: mixing circuit;
251: coil; and
252: capacitor Having described the invention, the following is claimed:

1. A spark plug comprising:

a tubular metal shell;

an insulator having at least a part of an outer circumference thereof held by the metal shell and having an axial hole;

a center electrode provided in the axial hole;

a ground electrode having a base end portion fixed to the metal shell, and having one side surface, of a front end portion of the ground electrode, opposing an end surface of the center electrode through a gap; and a noble metal tip provided on the one side surface side of the ground electrode, said noble metal tip having a front end that projects forward of the front end portion of the ground electrode, wherein an end surface of the front end portion of the ground electrode and the front end of the noble metal tip are positioned between an imaginary straight line and a centerline of the center electrode, said imaginary straight line being parallel to the center line of the center electrode and passing through an end point, of the end surface of the center electrode, said end point being disposed on a side opposite to a side closer to the base end portion of the ground electrode, when S1 represents an area of an overlap region in which a region onto which the end surface of the center electrode is projected overlaps a region onto which the noble metal tip is projected when the noble metal tip and the end surface of the center electrode are projected onto an imaginary plane perpendicular to the center line, and S2 represents an area of an overlap region in which a region onto which the noble metal tip is projected overlaps a region onto which the ground electrode is projected when the noble metal tip and the ground electrode are projected onto the imaginary plane, $0.22 \leq S1/S2 \leq 0.68$ is satisfied.

2. The spark plug according to claim 1, wherein the noble metal tip projects toward the center electrode from the one side surface of the ground electrode, and a projection amount by which the noble metal tip projects from the one side surface toward the center electrode is less than or equal to 0.35 mm.

3. The spark plug according to claim 1, wherein a coefficient of thermal conductivity of the ground electrode is higher than a coefficient of thermal conductivity of the noble metal tip.

4. The spark plug according to claim 1, wherein the ground electrode has thereinside a core material having a coefficient of thermal conductivity which is higher than that of the ground electrode.

5. The spark plug according to claim 2, wherein a coefficient of thermal conductivity of the ground electrode is higher than a coefficient of thermal conductivity of the noble metal tip.

6. The spark plug according to claim 2, wherein the ground electrode has thereinside a core material having a coefficient of thermal conductivity which is higher than that of the ground electrode.

7. The spark plug according to claim 3, wherein the ground electrode has thereinside a core material having a coefficient of thermal conductivity which is higher than that of the ground electrode.

8. An ignition system comprising:

a spark plug having a tubular metal shell;

an insulator having at least a part of an outer circumference thereof held by the metal shell and having an axial hole;

a center electrode provided in the axial hole;

a ground electrode having a base end portion fixed to the metal shell, and having one side surface, of a front end portion of the ground electrode, opposing an end surface of the center electrode through a gap; and a noble metal tip provided on the one side surface side of the ground electrode, said noble metal tip having a front end that projects forward of the front end portion of the ground electrode, wherein an end surface of the front end portion of the ground electrode and the front end of the noble metal tip are positioned between an imaginary straight line and a centerline of the center electrode, said imaginary straight line being parallel to the center line of the center electrode and passing through an end point, of the end surface of the center electrode, said end point being disposed on a side opposite to a side closer to the base end portion of the ground electrode, when S1 represents an area of an overlap region in which a region onto which the end surface of the center electrode is projected overlaps a region onto which the noble metal tip is projected when the noble metal tip and the end surface of the center electrode are projected onto an imaginary plane perpendicular to the center line, S2 represents an area of an overlap region in which a region onto which the noble metal tip is projected overlaps a region onto which the ground electrode is projected when the noble metal tip and the ground electrode are projected onto the imaginary plane, $0.22 \leq S1/S2 \leq 0.68$ is satisfied;

a first power supply configured to apply, between the center electrode and the ground electrode, first power for causing spark discharge in the spark plug; and a second power supply configured to apply second power while the spark discharge is generated.

9. The ignition system according to claim 8, wherein the noble metal tip projects toward the center electrode from the one side surface of the ground electrode, and a projection amount by which the noble metal tip projects from the one side surface toward the center electrode is less than or equal to 0.35 mm.

10. The ignition system according to claim 8, wherein a coefficient of thermal conductivity of the ground electrode is higher than a coefficient of thermal conductivity of the noble metal tip.

11. The ignition system according to claim 8, wherein the ground electrode has thereinside a core material having a coefficient of thermal conductivity which is higher than that of the ground electrode.

* * * * *